US008595955B2

(12) United States Patent
Bae et al.

(10) Patent No.: US 8,595,955 B2
(45) Date of Patent: Dec. 3, 2013

(54) LAUNDRY DRYER

(75) Inventors: Sang Hun Bae, Changwon-si (KR); Chul Jin Choi, Changwon-si (KR); Dong Hyun Kim, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1022 days.

(21) Appl. No.: 12/309,693

(22) PCT Filed: Jul. 27, 2007

(86) PCT No.: PCT/KR2007/003627
§ 371 (c)(1),
(2), (4) Date: Jan. 27, 2009

(87) PCT Pub. No.: WO2008/013426
PCT Pub. Date: Jan. 31, 2008

(65) Prior Publication Data

US 2009/0260246 A1 Oct. 22, 2009

(30) Foreign Application Priority Data

Jul. 28, 2006 (KR) ..... 10-2006-0071614
Jul. 28, 2006 (KR) ..... 10-2006-0071615
Jul. 28, 2006 (KR) ..... 10-2006-0071617

(51) Int. Cl.
*F26B 11/02* (2006.01)
*F26B 5/04* (2006.01)
*F04F 10/00* (2006.01)

(52) U.S. Cl.
USPC ..... 34/603; 34/411; 34/597; 137/138.5; 137/150.5

(58) Field of Classification Search
USPC ..... 34/60, 82, 411, 261, 390, 409, 34/595–597, 603, 607, 198, 275, 10; 222/386, 95, 105; 137/147, 282, 137/565.11; 239/88, 215, 349, 360; 417/36, 417/37, 39, 44.2, 235, 315, 425; 68/5 R, 68/12.05, 12.07, 12.18, 12.21, 171, 175
See application file for complete search history.

(56) References Cited

U.S. PATENT DOCUMENTS

| | | | | |
|---|---|---|---|---|
| 4,213,474 | A * | 7/1980 | Harrison | 134/102.2 |
| 4,813,574 | A * | 3/1989 | Hwan | 222/325 |
| 7,356,945 | B2 * | 4/2008 | Choi et al. | 34/597 |
| 2006/0272359 | A1 * | 12/2006 | Kang | 68/17 R |
| 2007/0151312 | A1 * | 7/2007 | Bruce et al. | 68/3 R |

FOREIGN PATENT DOCUMENTS

| | | | |
|---|---|---|---|
| EP | 1 600 545 | | 11/2005 |
| EP | 1 734 170 | | 12/2006 |
| JP | 2000/317192 | A | 11/2000 |
| KR | 20-1997-039170 | Y1 | 7/1997 |
| KR | 20-0201898 | Y1 | 8/2000 |
| KR | 2003-091512 | A | 12/2003 |
| KR | 10-2006-0046802 | A | 5/2006 |
| WO | WO 2007/145451 | | 12/2007 |

* cited by examiner

*Primary Examiner* — Kenneth Rinehart
*Assistant Examiner* — John McCormack
(74) *Attorney, Agent, or Firm* — McKenna Long & Aldridge LLP

(57) ABSTRACT

The present invention relates to a laundry dryer. The laundry dryer has a drum rotatably provided to a cabinet, a hot air heater heating air to supply hot air to the drum, a steam generator selectively supplying steam to the drum, and a water supply source provided to one side of the cabinet. And, the water supply source has an accommodating part for storing water supplied to the steam generator and a water supply means for supplying the water within the accommodating part to the steam generator.

27 Claims, 7 Drawing Sheets

LAUNDRY DRYER

This application is a National Stage entry of International Application No. PCT/KR2007/003627, filed Jul. 27, 2007, and claims the benefit of Korean Application Nos. 10-2006-0071614, 10-2006-0071615, and 10-2006-0071617, all filed on Jul. 28, 2006, each of which are hereby incorporated by reference for all purposes as if fully set forth herein.

TECHNICAL FIELD

The present invention relates to a laundry dryer, and more particularly, to a laundry dryer suitable for removing or preventing creases or wrinkles on clothes and the like.

BACKGROUND ART

A laundry dryer is a home appliance for drying a washed laundry, e.g., dresses using hot air. In general, a laundry dryer includes a drum for accommodating an object to be dried therein, a driving source for driving the drum, a heating means for heating air introduced into the drum, a blower unit for sucking air into the drum or discharging air from the drum, and the like.

Laundry dryers can be categorized into an electrical type laundry dryer and a gas type laundry dryer according to a system for heating air, i.e., a heating means. The electrical type laundry dryer heats air using electric resistance heat genera. And, the gas type laundry dryer heats air using heat generated from gas combustion.

Moreover, laundry dryers can be categorized into a condensing type laundry dryer and an exhaust type laundry dryer. In the condensing type laundry dryer, air exchanges heat with an object to be dried in a drum and then turns into humid air. The humid air circulates within the laundry dryer without being externally discharged. The circulating humid air exchanges heat with external air by a separate condenser to generate condensed water. The condensed water is then drained cut of the laundry dryer. In the exhaust type laundry dryer, air exchanges heat with an object to be dried in a drum and then turns into humid air. The humid air is directly discharged out of the laundry dryer.

Besides, laundry dryers can be categorized into a top loading type laundry dryer and a front loading type laundry dryer according to a system for putting an object to be dried into a laundry dryer. In the top loading type laundry dryer, an object to be dried is put into the laundry dryer via a topside of the laundry dryer. In the front loading type laundry dryer, an object to be dried is put into the laundry dryer via a front side of the laundry dryer.

DISCLOSURE OF INVENTION

Technical Problem

However, the above-explained laundry dryers of the related art have the following problems.

First of all, a wash-completed and dewatered laundry is normally put into a laundry dryer and then dried. Yet, the water-washed laundry creases due to the water washing. The creases are not completely removed in a drying course of the laundry dryer. So, the related art laundry dryer is disadvantageous in that the creases in such an object as a laundry dried by the related art laundry dryer need to be ironed out.

Secondly, in case of keeping or using dresses and the like as well as the wash-completed laundry, creases, wrinkles, folds, ad the like (hereinafter collectively named 'creases') are generated. So, the demand for a device for conveniently removing the creases formed in the dresses and the like according to normal keeping or use rises.

Technical Solution

Accordingly, the present invention is directed to a laundry dryer that substantially obviates one or more of the problems due to limitations and disadvantages of the related art.

An object of the present invention is to provide a laundry dryer, by which creases in dresses and the like can be prevented and/or removed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a laundry dryer according to the present invention includes a drum rotatably provided to a cabinet, a hot air heater heating air to supply hot air to the drum, a steam generator selectively supplying steam to the drum, and a water supply source provided to one side of the cabinet. And, the water supply source includes an accommodating part for storing water supplied to the steam generator and a water supply means for supplying the water within the accommodating part to the steam generator.

Preferably, the water supply means includes a pressurizing part for supplying the water within the accommodating part to the steam generator by pressurizing the water.

More preferably, the pressurizing part includes a pressurizing member moving along an open one side of the accommodating part to pressurize the water stored in the accommodating part and a sealing member provided along a surface of the pressurizing member.

And, the pressurizing part further includes a handle provided to one side of the pressurizing member.

Moreover, the accommodating part further includes an inject hole for injecting the water into the accommodating part and a cap for opening/closing the injection hole.

Besides, the laundry dryer further includes a water supply hose connecting the accommodating part and the steam generator together and a backward-flowing preventing means provided to the water supply hose.

In this case, the backward-flowing preventing means includes a check valve.

Meanwhile, the pressurizing member moves from the open one side of the accommodating part in a horizontal or vertical direction.

And, the laundry dryer further includes a moving means for moving the pressurizing member.

In this case, the moving means includes a horizontal bar connected to the pressurizing member to make a horizontal movement and a rotatable member connected to one end of the horizontal bar to be rotatably installed.

And, the rotatable member is rotatably moved between a pressurizing position where the pressurizing member pressurizes the water and a releasing position where the pressurizing member does not pressurize the water.

Moreover, the moving means further includes an elastic member for applying an elastic force to the releasing position if the rotatable member is rotatably moved to the pressurizing position.

More preferably, the accommodating part includes an expandable/contractible bellows part to have a space for storing the water therein and the pressurizing part is provided to one end of the bellows part.

In this case, the laundry dryer further includes an injection hole provided to the pressurizing part to inject the water into the bellows part and a supply passage connected to the injection hole.

And, the laundry dryer further includes a cap for opening/closing the injection hole.

Moreover, the laundry dryer further includes a packing part configured to be rotatably moved to open/close the injection hole.

Besides, the laundry dryer further includes a sealing member sealing the supply passage if the bellows part is contracted by the pressurizing part.

In this case, the laundry dryer further includes a cover for covering the pressurizing part and the bellows part if the bellows part is contracted by the pressurizing part. And, the sealing member is provided to a bottom of the cover.

Besides, the laundry dryer further includes a water supply hose connecting the bellows part and the steam generator together and a backward-flowing preventing means provided to the water supply hose.

And, the laundry dryer further includes a first damper provided along the supply passage and a second damper provided between the bellows part and the steam generator.

Moreover, the laundry dryer further includes a filter provided along the supply passage.

Preferably, the water supply means includes the accommodating part rotatably provided to the steam generator to supply the water to the steam generator by a water column difference.

More preferably, the accommodating part is rotatably provided in a vertical direction.

In this case, a connecting portion for connecting the accommodating part and the steam generator includes a rotatable flexible member.

And, the accommodating part includes a water supply port for supplying the water to the steam generator and a damper turning on/off the water supply port.

In this case, the damper is fixed to an inside of the accommodating part in the vicinity of the water supply port, the damper turns on the water supply port if the accommodating part is rotatably turned to rise, and the damper turns off the water supply port if the accommodating part is lowered.

Besides, the laundry dryer further includes an auxiliary cover provided to the cabinet to correspond to the accommodating part.

Preferably, the water supply source is provided to the cabinet to be pulled out or pushed in the cabinet.

More preferably, the drawer is provided to a front side of the cabinet.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

In the following description to explain a dryer and a controlling method thereof according to the present invention, a top-loading electrical condensing type laundry dryer is taken as an exemplary embodiment of the present invention for convenience of explanation. Yet, the present invention is not limited to this. And, it is a matter of course that the present invention is applicable to a front-loading gas condensing type dryer and the like.

Figure 1:
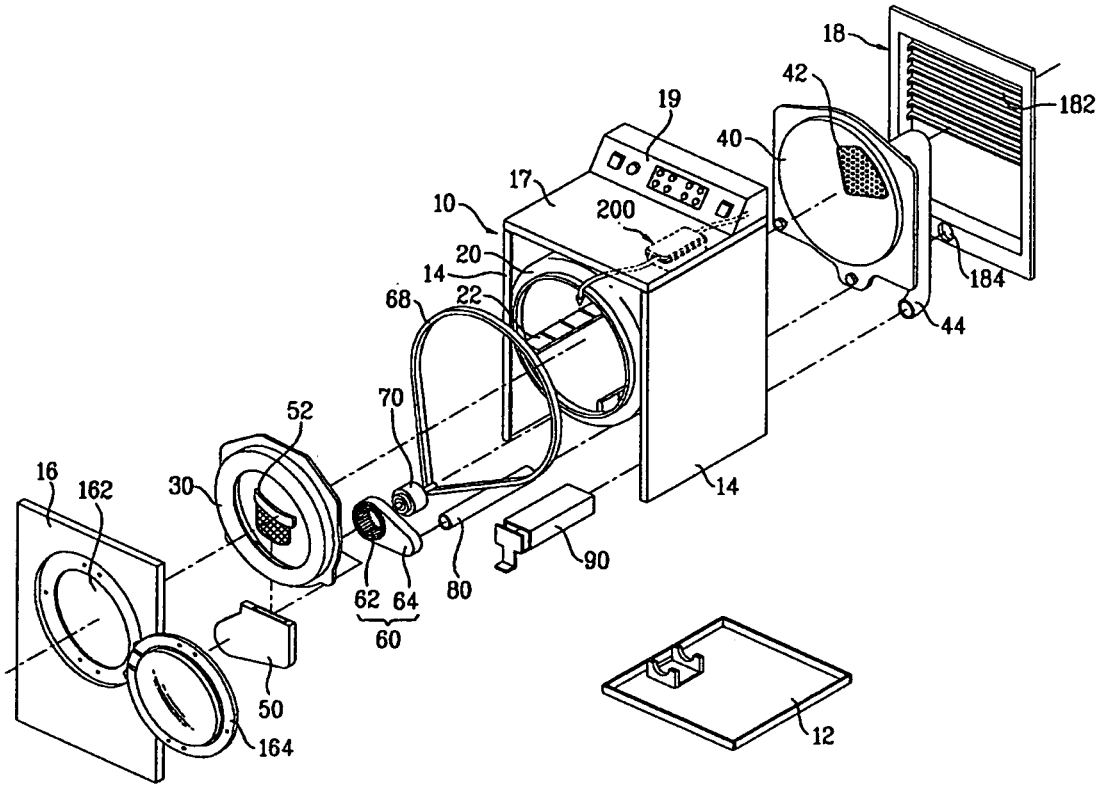
FIG. 1 is an exploded perspective diagram of a laundry dryer according to one preferred embodiment of the present invention.
Figure 2:
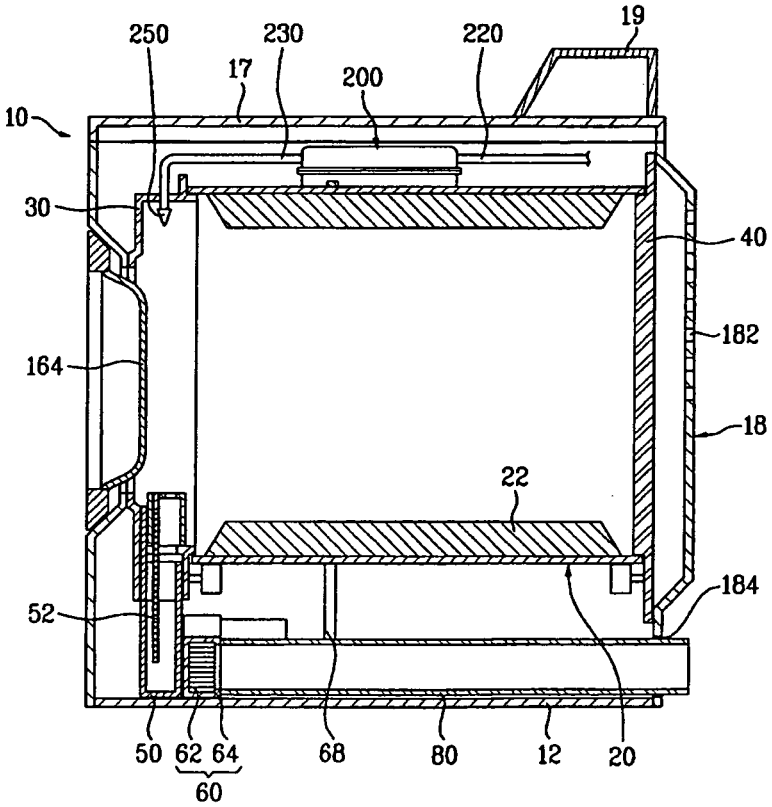
FIG. 2 is a vertical cross-sectional diagram of FIG. 1.

A laundry dryer according to one embodiment of the present invention is explained with reference to FIG. 1 and FIG. 2 as follows.

A rotatable drum 20 and a motor 70 and belt 69 for driving the drum 20 are installed within a cabinet 10 that configures an exterior of a laundry dryer.

A heater 90 (for convenience, hereinafter named a hot air heater) for generating high-temperature air (hereinafter named 'hot air') by heating air and a hot air supplying duct 44 for supplying the hot air generated by the hot air heater 90 to the drum 20 are provided to prescribed positions at the cabinet 10.

And, an exhaust duct 80 for discharging humid air having exchanged heat with an object to be dried in the drum 20, a blower unit 60 for sucking in the humid air, and the like are provided.

Moreover, a steam generator 200 generating high-temperature steam is provided to a prescribed position at the cabinet 10.

In the present embodiment, an indirect drive type for rotating the drum 20 using the motor 70 and the belt 68 are described, which does not put limitation of the present invention. Alternatively, the present invention is applicable to a direct drive type for directly rotating the drum 20 by a motor directly assembled to a backside of the drum 20.

The above-explained elements are explained in detail as follows.

The cabinet 10 forms an exterior of the laundry dryer. And, the cabinet 10 includes a base 12 forming a bottom floor, a pair of lateral covers 14 vertically provided to the base 12, a front cover 16 provided to a front side of the lateral covers 14, a rear cover 18 provided to a rear side of the lateral covers 14, and a top cover 17 provided onto the lateral covers 14.

A control panel 19 having various operation switches and the like is generally provided to the top cover 17 or the front cover 16. And, a door 164 is assembled to the front cover 16.

And, the rear cover 18 is provided with an intake part 182 for introducing external air and an exhaust hole 184 as a final passage for discharging air from the drum 20.

An inner space of the drum 20 performs a drying chamber function for a drying process. Preferably, a lift 22 is provided within the drum 20 to raise drying efficiency by turning over an object to be dried in a manner of lifting up the object to fall.

Meanwhile, a front supporter 30 and a rear supporter 40 are provided between the drum 20 and the cabinet 10, in particular, between the drum 20 and the front cover 16 and between the drum 20 and the rear cover 18, respectively.

The drum 20 is rotatably provided between the front supporter 30 and the rear supporter 40. And, a sealing member (not shown in the drawings) is provided between the drum 20 and each of the front and rear supporters 30 and 40. In particular, the front and rear supporters 30 and 40 covers front and rear sides of the drum 20 to construct a drying chamber and plays a role in supporting front and rear ends of the drum 20.

An opening for enabling the drum 20 to communicate with an external environment of the laundry dryer is provided to the front supporter 30. And, the opening is selectively closed or opened by the door 164.

A lint duct 50 is connected to the front supporter 30 to play a role as a passage for discharging the air of the drum 20 to the external environment. And, a lint filter 52 is provided to the lint duct 50.

One end of the blower unit 60 is connected to the lint duct 50, while the other end of the blower unit 60 is connected to the exhaust duct 80. And, the exhaust unit 80 is configured to communicate with the exhaust hole 184 provided to the rear cover 18.

Once the blower unit 60 is activated, air within the drum 20 is externally discharged via the lint duct 50, the exhaust duct 80, and the exhaust hole 184. In this case, particles including the lint, fuzz and the like are filtered off by the lint filter 52. Generally, the blower unit 60 includes a blower 62 and a blower housing 64. And, the blower 64 is normally driven by being connected to the motor 70 for driving the drum 20.

Another opening 42 including a multitude of perforated holes is provided to the rear supporter 40. And, the hot air supplying duct 44 is connected to the opening 42. The hot air supplying duct 44 is configured to communicate with the drum 20 to play a role as a passage for supplying hot air to the drum 20. So, the hot air heater 90 is installed at a prescribed position at the hit air supplying duct 44.

Figure 3:
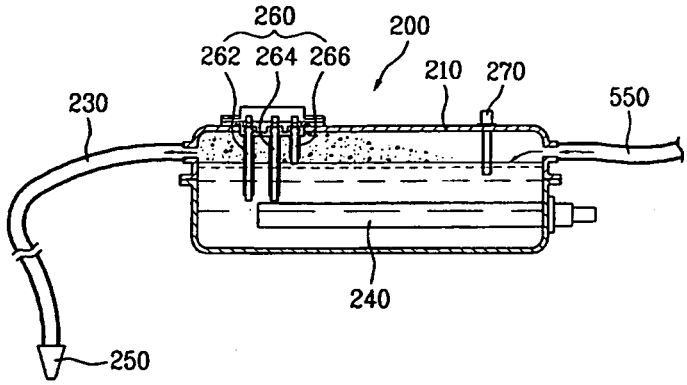
FIG. 3 is a cross-sectional diagram of an internal configuration of a steam generator shown in FIG. 1.

Meanwhile, the steam generator 200 is provided to a prescribed position at the cabinet 10 to generate and supply steam to an inner space of the drum 20. The steam generator 200 is explained in detail with reference to FIG. 3 as follows.

The steam generator 200 includes a water tank 210 for accommodating water therein, a heater 240 provided within the water tank 210, a water level sensor 260 measuring a water level of the steam generator 200, and a temperature sensor 270 sensing a temperature of the steam generator 200. The water level sensor 260 normally includes a common electrode 262, a low water level electrode 264, and a high water level electrode 266. And, the water level sensor 260 detects a high water level or a low water level according to whether an electric current between the common electrode 262 and the high/low water level electrode 264/266 is turned on.

A water supply hose 220 for supplying water is connected to one side of the steam generator 200, while a steam hose 230 for discharging steam is connected to the other side of the steam generator 200. Preferably, a nozzle 250 in a prescribed shape is provided to a front end of the steam hose 230. One end of the water supply hose 220 is connected to an external water supply source such as a tap. And, a front end portion of the steam hose 230 or the nozzle 250, i.e., a steam cutlet is provided to a prescribed position at the drum 20 to inject steam into the drum 20.

Meanwhile, the present embodiment deals with the steam generator 200 (for convenience, hereinafter named 'cheating type generator') that generates steam in a manner that a prescribed quantity of water stored in the water tank 210 having a prescribed size is heated by the heater 240, which does not put limitation of more embodiments of the present invention. So, any device capable of generating steam can be used as a steam generator of the present invention. For instance, the present invention can employ a generator (for convenience, hereinafter named 'pipe-heating type generator') for heating water in a manner of installing a heater directly on a circumference of a water supply hose without storing water in a prescribed space.

A water supply source of a laundry dryer according to a first embodiment of the present invention is explained with reference to FIG. 4 as follows.

In the present embodiment, water is supplied to a steam generator 200 using a water supply source provided to a laundry dryer instead of using an external water supply source such as a tap. As mentioned in the foregoing description, a tap is usable as the water supply source for the steam generator 200. In this case, installation gets complicated. Since water is not normally used for a laundry dryer, if a tap is used as a water supply source, various accompanying devices need to be installed in addition. The present embodiment employs a water supply source according to the principle of syringe. So, water is supplied to the steam generator 200 in a manner of injecting water into the water supply source and connecting the water supply source filled with the injected water to the steam generator 200.

Embodiments of a water supply source according to the present invention are explained with reference to the accompanying drawings as follows.

Figure 4:
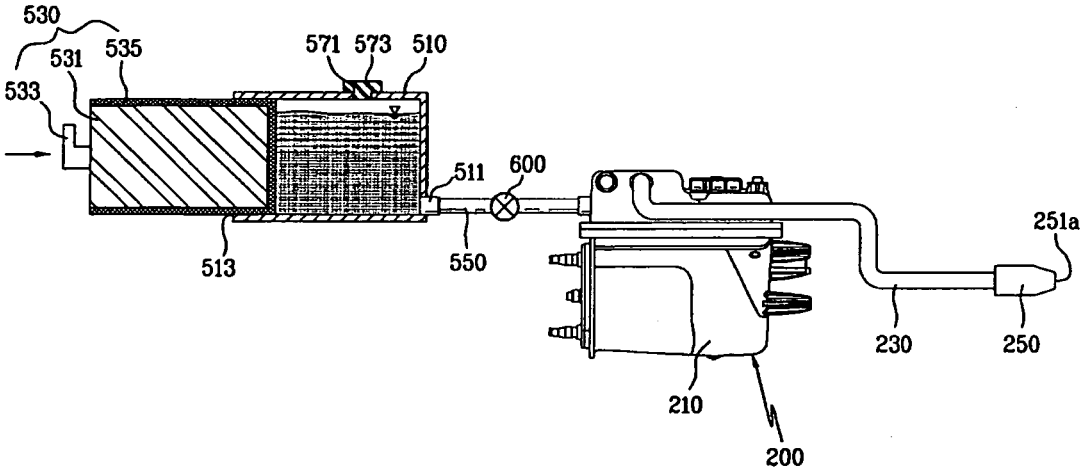
FIG. 4 and FIG. 5 are diagrams for configuration of a water supply source in a dryer according to a first embodiment of the present invention.
Figure 5:
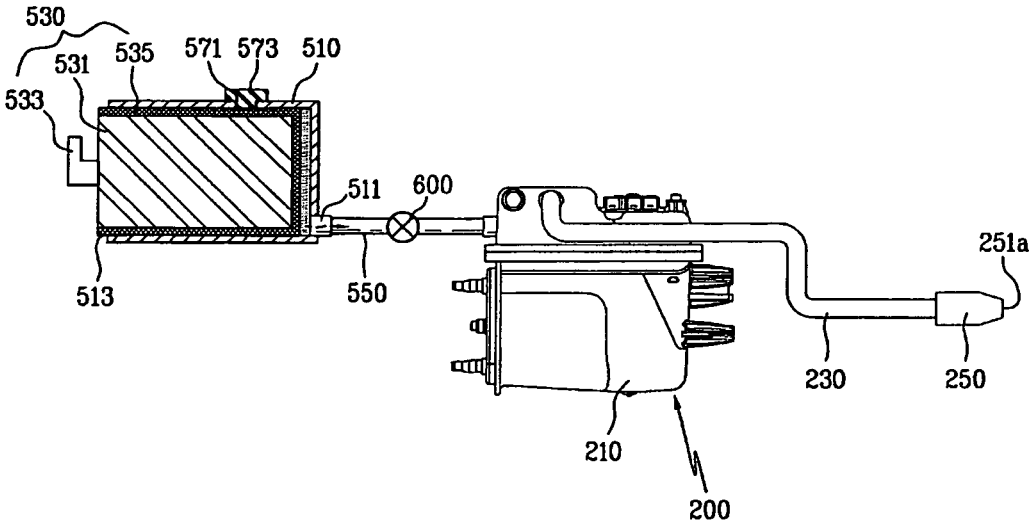

Referring to FIG. 4 and FIG. 5, a water supply source according to a first embodiment of the present invention mainly includes an accommodating part 510 for accommodating water therein, a pressurizing part 530, and a water supply hose 550.

The accommodating part 510 is configured to have a space for storing water therein. And, the accommodating part 510 is also configured to have an outlet 511 for draining the stored water.

In this case, it is preferable that an opening 513 is provided to one side of the accommodating unit 510, i.e., to one side opposite to the cutlet 511. This is to enable the pressurizing part to be movably installed. So, the pressurizing unit 530 can apply a pressure to the water within the accommodating part 510.

Preferably, an injection hole 571 for injecting water into the accommodating part from outside is provided to the accommodating part 510. Preferably, a cap 573 for opening/closing the injection hole 571 selectively is provided.

The pressurizing part 530 is provided to supply water to the water tank 210 of the steam generator 200 by applying a pressure to the water within the accommodating part 510. In the present embodiment, it is proposed that the pressurizing part 530 is configured to pressurize the water stored in the accommodating part 510 in a horizontal direction.

The pressurizing part 530 can include a pressurizing member 531 for pressurizing the water stored in the accommodating part 510 and a handle 533 for moving the pressurizing member 531.

Preferably, a sealing member 535 is provided to the pressurizing member 531 of the pressurizing part 530 to prevent the water stored within the accommodating part 510 from leaking. More preferably, the sealing member 535 is provided to a circumference of the pressurizing member 531 to make the pressurizing member 531 adhere closely to an inner surface of the accommodating part 510. So, the sealing member 535 plays a role in preventing the water within the accommodating part 510 from leaking toward the opening 513.

One end of the water supply hose 550 is connected to the outlet 511 of the accommodating part 510 and the other end of the water supply hose 550 is connected to the water tank 210 of the steam generator 200. So, the water supply hose 550 plays a role in guiding the water stored within the accommodating part 510 to the water tank 210 of the steam generator 200.

Preferably, a check valve 600 is provided to the water supply hose 550 to prevent the water introduced into the steam generator 200 or the steam is generated from the steam generator from flowing backward to the accommodating part 510.

When the steam generator 200 is operating normally, the steam is injected into the drum via the steam hose 230 and the nozzle 250.

Yet, if fine fabric particles including lint or particles generated in the course of drying clothes or dresses are attached and accumulated on an injection hole 251*a* of the nozzle 250, the injection hole 251*a* becomes blocked. If so, the steam is not smoothly discharged into the drum but may work as a pressure to flow toward the accommodating part 510 via the water supply hose 550. And, the water within the steam generator may flow backward to the accommodating part. In this case, the switching part 630 of the check valve 600 closes the water supply hose 550 to play a role in preventing the water and steam from flowing backward to the accommodating part 510.

Figure 6:
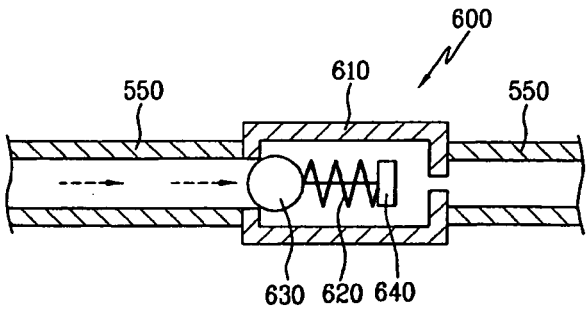
FIG. 6 and FIG. 7 are cross-sectional diagrams for internal configuration of a check valve shown in FIG. 4.
Figure 7:
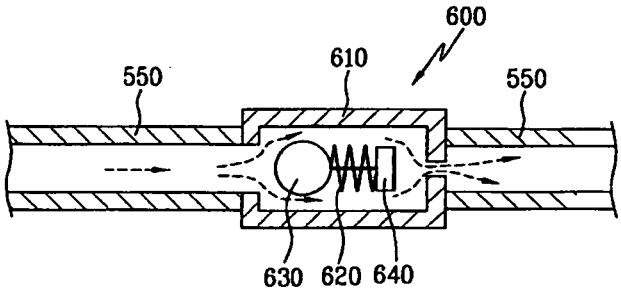

The check valve is explained in detail with reference to FIG. 6 and FIG. 7 as follows. FIG. 6 shows a status before water is supplied to a water supply hose. FIG. 7 shows a status that a valve is working as water is supplied to a water supply hose.

The check valve 600 includes a case 610 configured to communicate with both ends of a water supply hose 550 and a switching part 630 for selectively turning on/off the case 510 and the water supply hose 550. The switching part 630 is provided within the case 610 and supported by a spring 620. One end of the spring 620 is supported by the switching part 630 and the other end is supported by a fixing part 640 fixed to the case 610 is a prescribed manner.

According to one embodiment of the present invention, a drawer type container (hereinafter called 'drawer' not shown in the drawings), which can be inserted/drawn, is provided to a prescribed position at a laundry dryer, the water supply means can be provided to the drawer, and the drawer can be provided to a front side of the laundry drawer. If the water supply means is provided to the drawer, an accommodating part 610 of the water supply means and a water supply hose 550 connected to the accommodating part 610 are preferably configured to be mutually disassembled or assembled by an operation of the drawer.

In particular, in case that the drawer is open to inject water into the accommodating part 510, both of the drawer and the accommodating part 510 move together. The cutlet 511 of the accommodating part 510 is separated from the water supply hose 550. If the drawer is closed while the water has been injected into the accommodating part 510, the cutlet 511 of the accommodating part 510 is assembled to the water supply hose 550.

Of curse, while the cutlet 511 of the accommodating part 510 is always connected to the water supply hose 550, a length of the water supply hose 550 is set long by considering a distance for the accommodating part 510 to move.

An operation of the above-configured water supply source is explained as follows.

First of all, referring to FIG. 4, water injection is completed via the injection hole 571 provided to the accommodating part 510. Referring to FIG. 5, the pressurizing member 531 is moved to the right in the drawing using the handle 533. In doing so, the pressurizing member 531 pressurized the water stored in the accommodating part 510 to supply water to the water tank 210 of the steam generator 200 via the water supply hose 550.

Through the above process, the water is supplied to the water tank 210 of the steam generator 200. If the water is supplied, the heater 240 of the steam generator 200 is activated to generate steam. The steam is supplied to the drum (cf. '20' in FIG. 1) via the nozzle 250 to perform a stem drying process.

Figure 8:
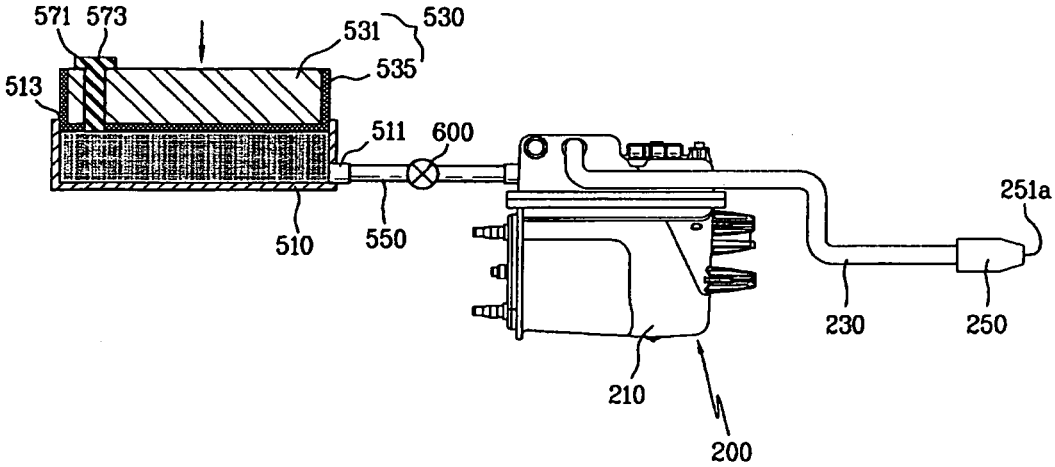
FIG. 8 and FIG. 9 are diagrams for configuration of a water supply source in a laundry dryer according to a second embodiment of the present invention.
Figure 9:
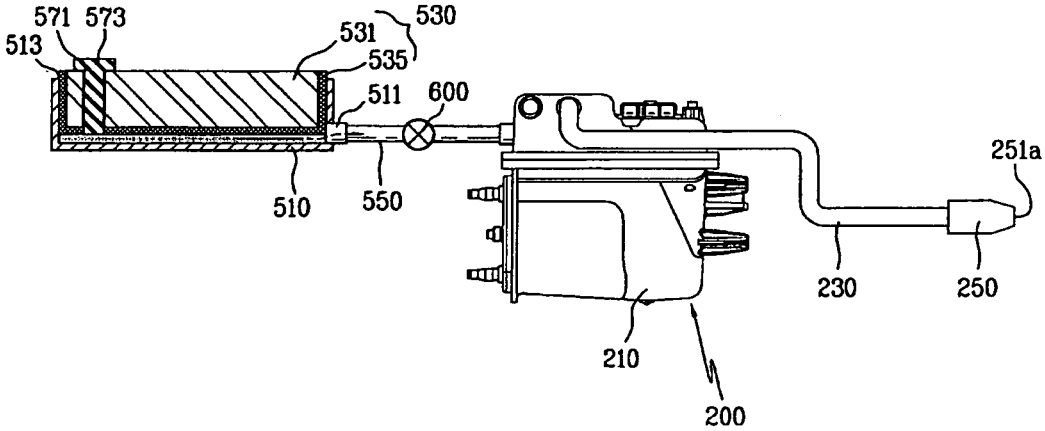

FIG. 8 and FIG. 9 are diagrams for configuration of a water supply source in a laundry dryer according to a second embodiment of the present invention.

Referring to FIG. 8 and FIG. 9, the pressurizing part 530 of the present embodiment differs from that of the former embodiment in that the water stored in the accommodating part 510 is pressurized in a vertical direction.

In particular, after the accommodating part 510 has been filled with water, a user downwardly presses the pressurizing part 536, as shown in FIG. 9, to apply a pressure to the water. So, the water is supplied to the water tank 210 via the water supply hose 550. Preferably, the injection hole 571 and the cap 573 are provided to the pressurizing part 530. As the rest configuration and operation are identical to those of the former embodiment, their details are omitted in the following description.

Figure 10:
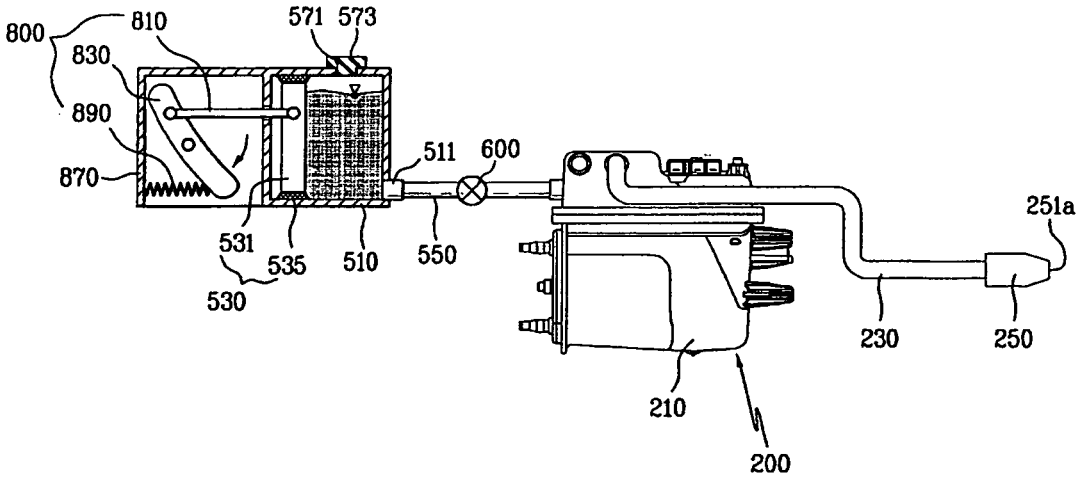
FIG. 10 and FIG. 11 are diagrams for configuration of a water supply source in a laundry dryer according to a third embodiment of the present invention.
Figure 11:
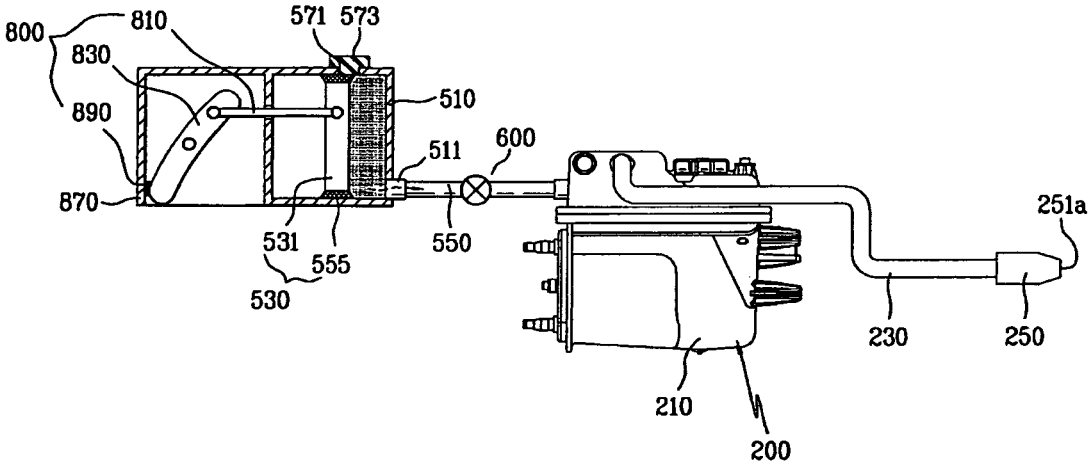

FIG. 10 and FIG. 11 are diagrams for configuration of a water supply source in a laundry dryer according to a third embodiment of the present invention. A water supply source according to the present embodiment is explained with reference to FIG. 10 and FIG. 11 as follows.

Referring to FIG. 10 and FIG. 11, a water supply source according to the present embodiment includes an accommodating part 510, a pressurizing part 530, a water supply hose 550, and a moving means 800. As the configurations of the accommodating part 510 and the water supply hose 550 are identical to those of the former embodiment, their details are omitted. Configurations of the pressurizing part and the moving means are explained in detail as follows.

The moving means 800 of the present embodiment are provided to move the pressurizing part 530.

In particular, the moving means 800 includes a horizontal bar 810 connected to the pressurizing part 531 to enable a horizontal movement and a rotatable member corrected to the horizontal bar 810 to enable the horizontal bar 810 to be moved. The rotatable member 830 is rotatably provided by a hinge structure. Preferably, a guide 870 is provided to one side of the accommodating part 510 to enable the rotatable member 830 to be fixed thereto.

In this case, one end of the horizontal bar 810 is connected to the rotatable member 839 and the other end is installed to be connected to the pressurizing member 531. If the rotatable member 830 is rotated, the horizontal bar 810 makes a horizontal movement to play a role in moving the pressurizing member 531 horizontally. In particular, FIG. 10 shows a status that the pressurizing member 531 does not pressurize the water as the rotatable member 830 is located at a releasing position. FIG. 11 shows that the pressurizing member 531 is moved to pressurize the water as the rotatable member 830 is rotationally moved to a pressurizing position.

Meanwhile, the moving means 800 can further include an elastic member 890. If the rotatable member 830 is rotated, the elastic member 890 enables the rotatable member to return to an initial position, i.e., to the releasing position. In this case, the elastic member 890 preferably includes a compression spring. One end of the elastic member 890 is connected to the Side 870 and the other end is connected to the rotatable member 830.

An operation of the above-configured water supply source is explained as follows.

First of all, if a water injection, as shown in FIG. 10, is completed via the injection hole 571 provided to the accommodating part 510, the rotatable member 830, as shown in FIG. 11, is pulled toward the guide 870.

If the rotatable member 83 is rotated counterclockwise in FIG. 10, the horizontal bar 810 is horizontally moved to the right to horizontally move the pressurizing member 531. In this case, the pressurizing member 531 applies a pressure to the water stored within the accommodating part 510 to supply the stored water to the water tank 210 of the steam generator via the water supply hose 550.

After completion of the water supply to the steam generator, if a user releases the force applied to the rotatable member 830, the elastic member 890 enables the rotatable member 830 to return to the releasing position shown in FIG. 10. And, the horizontal bar 810 and the pressurizing member 531 interoperate with the rotatable member 830 and return to the released position to enable water to be injected into the accommodating part 510 again.

Through the above process, water is supplied to the steam generator. Once the water is supplied, the heater 240 of the steam generator is activated to generate steam. The generated steam is supplied to the drum (cf. '20' in FIG. 1) to perform a stem drying course.

Figure 12:
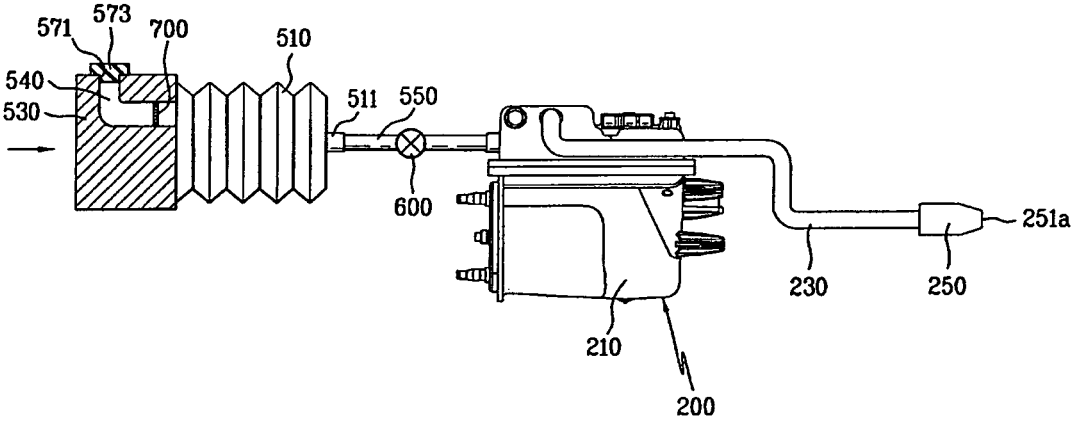
FIG. 12 and FIG. 13 are diagrams for configuration of a water supply source in a laundry dryer according to a fourth embodiment of the present invention.
Figure 13:
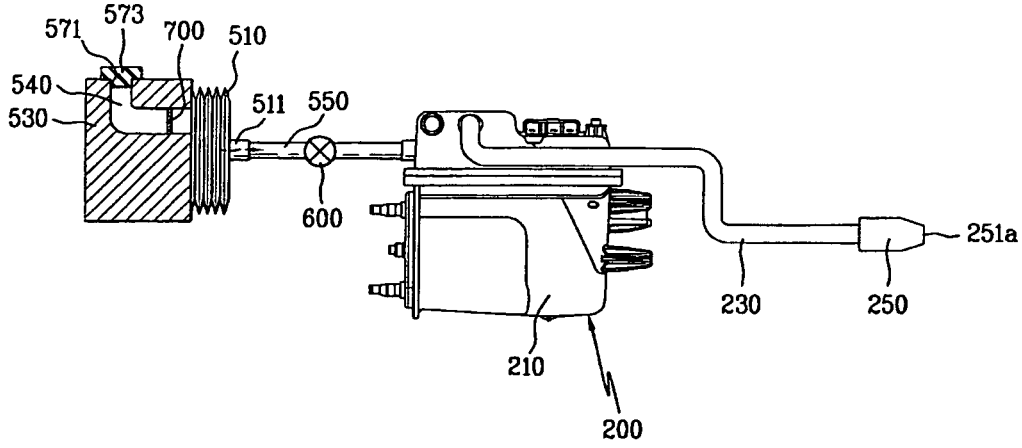

FIG. 12 and FIG. 13 are diagrams for configuration of a water supply source in a laundry dryer according to a fourth embodiment of the present invention.

Referring to FIG. 12 and FIG. 13, a water supply source of the present embodiment differs from those of the former embodiments in that an accommodating part for accommodating water therein includes a bellows part 510.

The bellows part 510 is configured to have a space for supplying water to a steam generator 200. Preferably, the bellows part 510 is configured to enable expansion/contraction by an external force.

In particular, if an external force is applied to the bellows part 510, the bellows part 510 is contracted to enable the water stored therein to flow to a water tank 210 of the steam generator. If an eternal force is applied in a reverse direction to the bellows part 510, the bellows part 510 is expanded to be ready to store water therein again.

The pressurizing part 530 is provided to one side of the bellows part 510 to play a role in applying an external force to the bellows part 510. Preferably, an injection hole 571 is provided to the pressurizing part 530 to inject water into the bellows part 510 from outside. Preferably, a cap 573 is provided to open/close the injection hole 571.

Preferably, the injection hole 571 is provided to an upper side of the pressurizing part 530. Preferably, a supply passage 540 is provided to the pressurizing part to enable the water injected into the injection hole 571 to flow to the bellows part 510. In particular, when the injection hole 571 and the supply passage are connected to communicate with each other, if water is injected via the injection hole 571, the injected water is guided by the supply passage 530 to be supplied into the bellows part 510.

Alternatively, instead of forming the supply passage within the pressurizing part, a space for storing water (not shown in the drawing) is provided within the pressurizing part and configured to communicate with the bellows part. So, water can be stored within the pressurizing part as well as the bellows part.

One end of the water supply hose 550 is connected to the cutlet 511 of the bellows part 510 and the other end is connected to the steam generator 200. So, the water stored within the bellows part 510 can be guided to the water tank 210 of the steam generator 200.

An operation of the above-configured water supply source according to the present embodiment is explained as follows.

First of all, in order to inject water into the bellows part 510, the pressurizing part 530 is pulled cut of the front side of the laundry dryer. In this case, the bellows part 530 connected to the pressurizing part 530 is expanded and a space for storing water is formed within the bellows part 530.

Subsequently, the cap 573 is opened to open the injection hole 571. Water is then injected via the injection hole 571 to enable the water to flow toward the bellows part 510 via the supply passage 540.

After completion of the water injection into the bellows part 510, the cap 573 is closed to close the injection hole 571. The pressurizing part 530 is then pushed in to contract the bellows part 530. If so, the water stored within the bellows part 510 is supplied to the water tank 210 of the steam generator 200 via the water supply hose 550.

After completion of the water injection into the water tank 210 of the steam generator 200, the heater (cf. '240' in FIG. 3) of the steam generator 200 is activated to generate steam. If so, the generated steam is supplied to the drum (cf. '20' in FIG. 2) via the nozzle 250 to perform the steam drying process.

Figure 14:
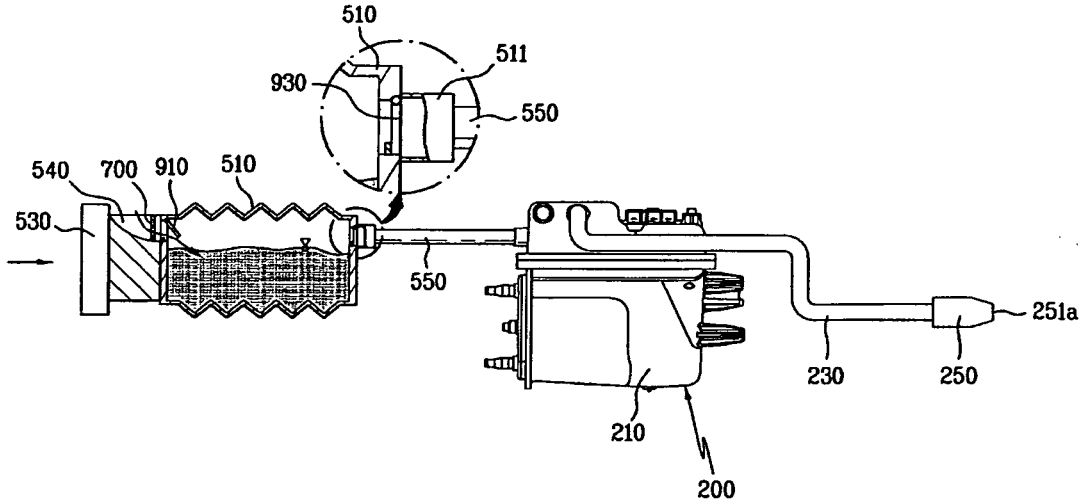
FIG. 14 and FIG. 15 are diagrams for configuration of a water supply source in a laundry dryer according to a fifth embodiment of the present invention.
Figure 15:
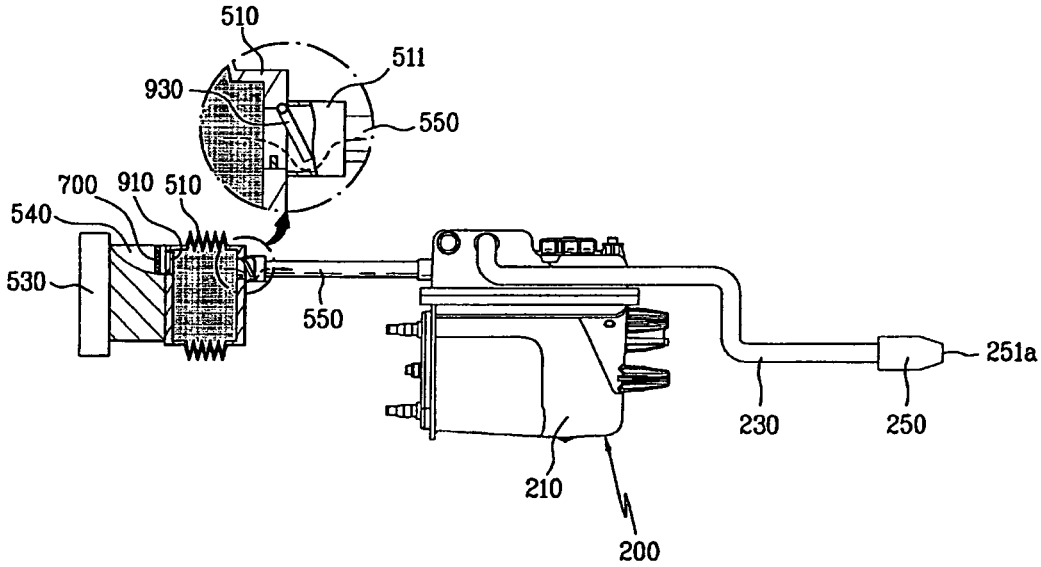

FIG. 14 and FIG. 15 are diagrams for configuration of a water supply source in a laundry dryer according to a fifth embodiment of the present invention.

Referring to FIG. 14 and FIG. 15, a laundry dryer according to the present embodiment differs from those of the former embodiments in that a damper is provided as a means for preventing water supplied by a water supply source from flowing backward instead of a check valve. The difference is mainly explained in the following description.

According to the present embodiment, the supply passage 540 is provided to the pressurizing part 530, a first damper 910 is provided to a portion where the supply passage and the bellows part contact with each other, and a second damper 930 is provided to a portion where the bellows part 510 and the water supply hose 550 are connected.

In case of supplying water to the bellows part 510, the water flows via the supply passage 540 to apply a pressure to the first damper 910. If so, the first damper 910, as shown in FIG. 14, is in an open status to enable water to be introduced into the bellows part 510. As the bellows part 510 is contracted by the pressurizing part 530, the water within the bellows part 510 applies a pressure to the second damper 930. If so, the second damper 930, as shown in FIG. 15, is opened to open the water supply hose 550. So, the water within the bellows part 510 flows into the water supply hose 550 to be supplied to the water tank 210 of the steam generator 200.

Preferably, both of the first and second dampers 910 and 930, as shown in FIG. 14 and FIG. 15, are configured to be turned in one direction only. In particular, if the bellows part 510 is filled with water, the first damper 910 prevents the water within the bellows part 510 from flowing backward to the supply passage 540 and the second damper 930 prevents the water having flown toward the steam generator from flowing backward to the bellows part 510.

As mentioned in the foregoing description of the former embodiment, according to the present embodiment, the pressurizing part can include a drawer type container (hereinafter called 'drawer') configured to be pulled in/out. And, the drawer can be provided to a front side of the laundry dryer.

An operation of the above-configured water supply source is explained as follows.

First of all, in order to inject water into the bellows part 510, the pressurizing part 530 is pulled cut of the front side of the body. In this case, the bellows part 510 connected to the pressurizing part 530 becomes expanded and a space for storing water is provided within the bellows part 510.

Subsequently, in case that water is supplied to the supply passage 540 provided to the pressurizing part 530, the first damper 910 is opened by a pressure of the supplied water to enable the water to flow into the bellows part 510.

After completion of the water supply into the bellows part 510, the pressurizing part 530 is pushed into the body of the laundry dryer to contract the bellows part 510. If so, the water stored within the bellows part 510 activates the second damper 930 by the pressure of the pressurizing part 530 to open the water supply hose 550 and is then supplied to the steam generator via the water supply hose 550.

After completion of the water supply to the steam generator 200, the heater (cf. '240' in FIG. 3) of the steam generator is activated to generate steam. The generated steam is then supplied to the drum (cf. '20' in FIG. 2) via the nozzle 250 to perform the steam drying process.

Figure 16:
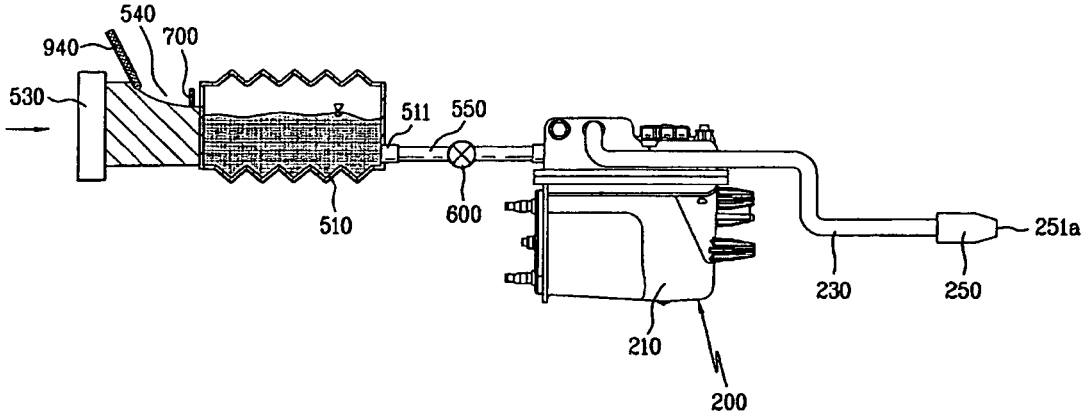
FIG. 16 and FIG. 17 are diagrams for configuration of a water supply source in a laundry dryer according to a sixth embodiment of the present invention.
Figure 17:
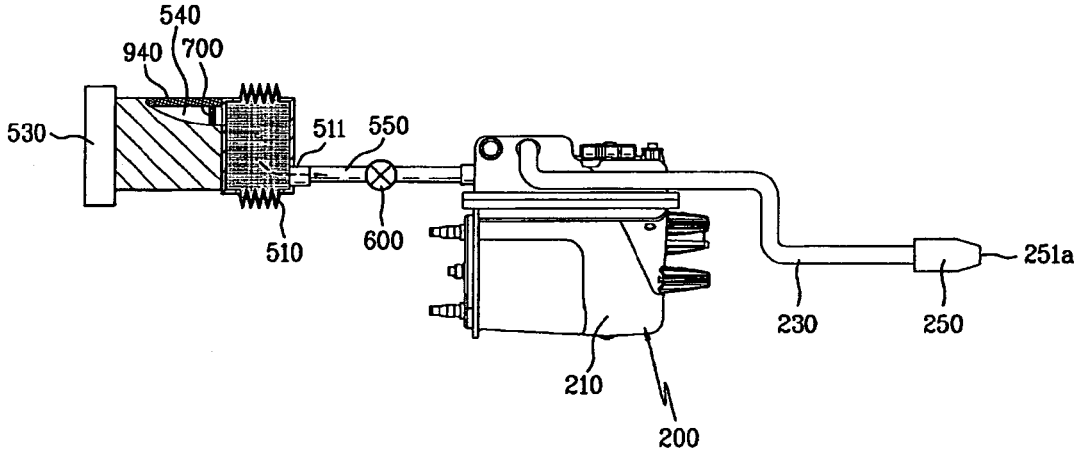

FIG. 16 and FIG. 17 are diagrams for configuration of a water supply source in a laundry dryer according to a sixth embodiment of the present invention.

Referring FIG. 16 and FIG. 17, there is a difference in that a packing part 940 for turning on/off a supply passage 540 is provided to an entrance of the supply passage 540 of the pressurizing part 530 instead of the first and second dampers 810 and 820 of the former embodiment shown in FIG. 14.

In particular, the packing part 940 is installed at an upper side of the supply passage 540 to turn on/off the supply passage 540 by a hinge structure. So, the packing part 940 plays a role in preventing water introduced into the bellows part 510 via the supply passage 540 from leaking outside. In this case, it is preferable that a check valve 600 is provided to the water supply hose 550 to prevent the water introduced into the steam generator 200 or steam from flowing backward to the bellows part 510. Other configurations except that of the packing part 940 are similar to those explained for the former embodiment shown in FIG. 14. So, their details are omitted in the following description.

Figure 18:
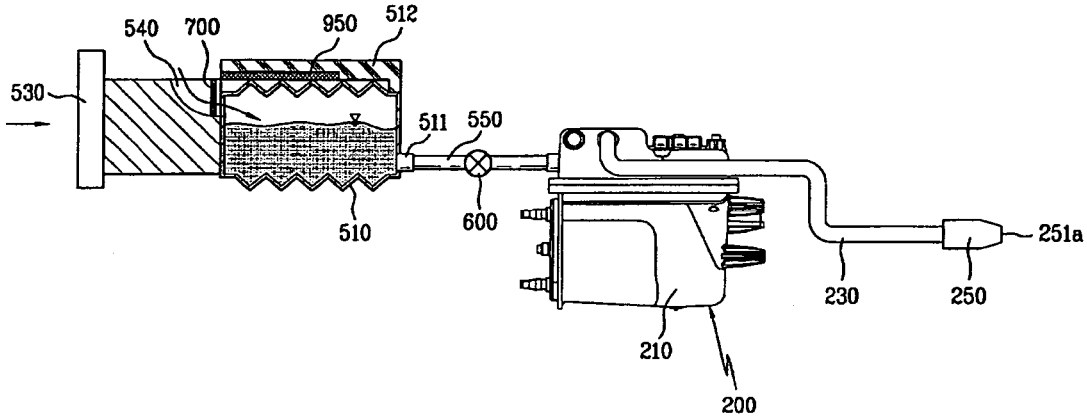
FIG. 18 and FIG. 19 are diagrams for configuration of a water supply source in a laundry dryer according to a seventh embodiment of the present invention.
Figure 19:
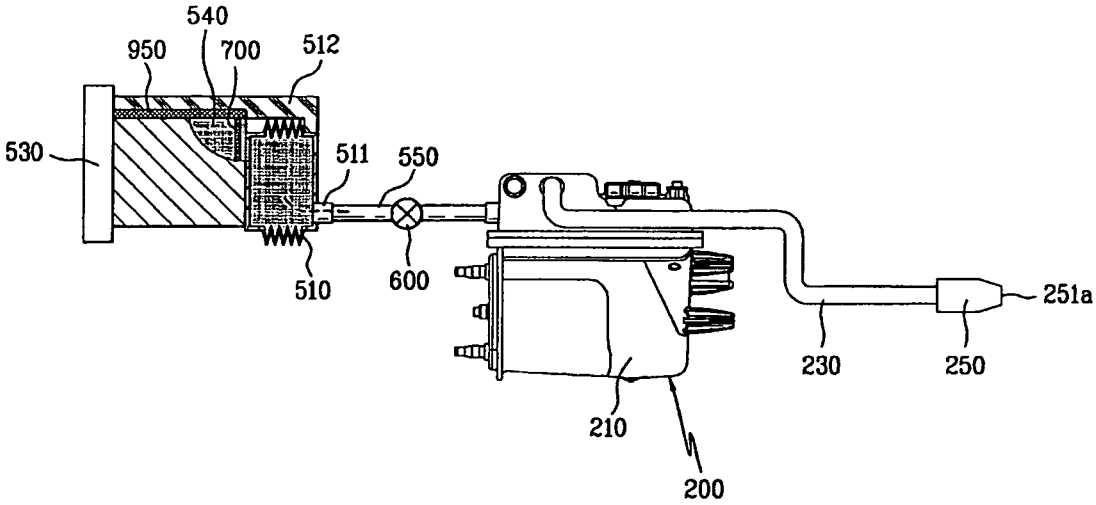

FIG. 18 and FIG. 19 are diagrams for configuration of a water supply source in a laundry dryer according to a seventh embodiment of the present invention.

Referring to FIG. 18 and FIG. 19, a water supply source according to the present embodiment differs from that of the formed embodiment shown in FIG. 14 in that a sealing member 950 provided on the bellows part 510 to seal the supply passage 540 provided to the pressurizing part 530 in case that the bellows part 510 is contracted. Preferably, the sealing member 950 is fixed to a body of a laundry dryer to maintain a fixed state not to be affected by a movement of the pressurizing part that is being pulled out or pushed in.

In particular, in the present embodiment, a cover 512 is provided on the bellows part 510. The cover 512 is configured to cover at least a portion of the bellows part 510 and the pressurizing part 530, i.e., the supply passage 540 of the pressurizing part 530 if the bellows part 510 is contracted by the pressurizing part 530.

Meanwhile, the sealing member 950 of the present embodiment is provided to a bottom of the cover 512. And, the sealing member 950 is located to seal the supply passage 540 provided to the pressurizing part 530 in case that the bellows part 510 is contracted by the pressurizing part 530.

In particular, after the pressurizing part 510 has been pulled out, water is supplied to the bellows part 510 via the supply passage 540 provided to the pressurizing part 530. If the pressurizing part 530 is moved, the water injected into the bellows part 510 is prevented from overflowing externally or leaking via the supply passage 540.

Preferably, as mentioned in the foregoing description, a check valve 600 is provided to the water supply hose 550 to prevent the water introduced into the steam generator or the steam from flowing backward to the bellows part 510.

Besides, according to each of the above embodiments of the present invention, a filter 700 for filtering the supplied water is further provided to the supply passage 540.

In particular, the filter 700 is provided to the supply passage to play a role in filtering off impurities including microscopic dust and the like mixed with the water supplied to the bellows part So, the filter 700 prevents the impurities from being accumulated on the steam generator 200 and the respective passages connected to the steam generator 200.

An operation of the above-configured water supply source is explained as follows.

First of all, in order to inject water into the bellows part 510, the pressurizing part 530 is pulled out of a front side of a body. In this case, the supply passage 540 provided over the pressurizing part 530 is open not to be covered with the cover 512. So, water can be supplied to the bellows part 510 via the supply passage 540.

Subsequently, after completion of the water supply into the bellows part 510, the pressurizing part 530 is pushed into the body of the laundry dryer to contract the bellows part 510. If so, the pressurizing part 530 is covered with the cover 512 together with the bellows part 510. And, the supply passage 540 over the pressurizing part 530 is sealed by the sealing member 950. So, it is able to prevent the water within the bellows part 510 from externally leaking again via the supply passage 540.

If the water stored in the bellows part 510 is supplied to the steam generator via the water supply hose 550 by the pressure of the pressurizing part 530, the heater (cf. '240' in FIG. 3) of the steam generator is activated to generate steam. The steam is then supplied to the drum (cf. '20' in FIG. 2) via the nozzle 250.

Figure 20:
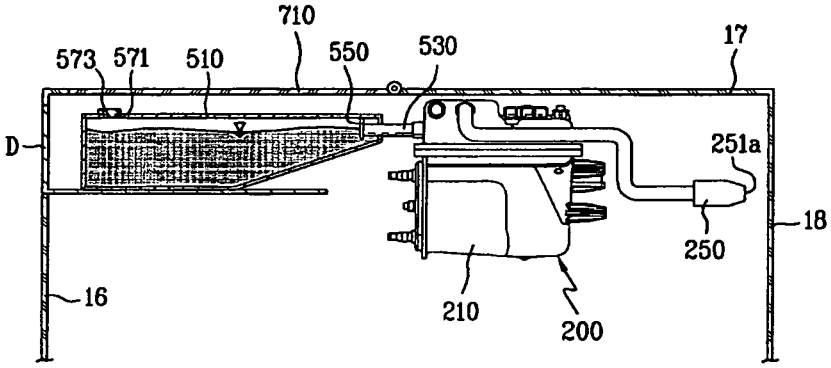
FIG. 20 and FIG. 21 are diagrams for configuration of a water supply source in a laundry dryer according to an eighth embodiment of the present invention.
Figure 21:
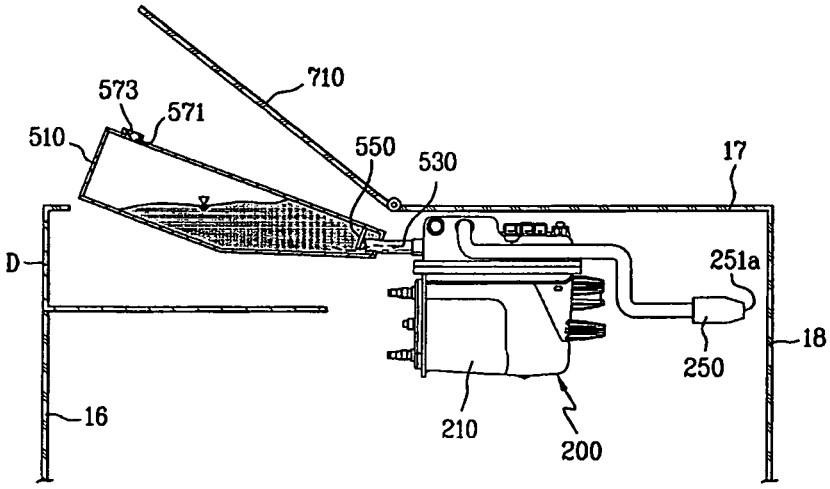

FIG. 20 and FIG. 21 are diagrams for configuration of a water supply source in a laundry dryer according to an eighth embodiment of the present invention.

Referring to FIG. 20 and FIG. 21, a water supply source according to the present embodiment includes an accommodating part 510 for storing water and a water supply port 530 connecting the accommodating part 510 and a steam generator together. The accommodating part 510 of the present embodiment differs from those of the former embodiments in having a space for string water to play a role in supplying the stored water to a water tank 210 of the steam generator by a water column difference between the stored water and the steam generator.

In particular, the accommodating part 510 is installed to be horizontal to the steam generator 200. In order to supply water to the steam generator 200, the accommodating part 510 is inclined upward to generate a water column difference between the accommodating part 510 and the steam generator 200. So, the water can naturally flow to the tank 210 of the steam generator from the accommodating part 510.

Preferably, an injection hole 571 is provided to the accommodating part 510 to inject water into the accommodating part 510. More preferably, a cap 573 is provided to selectively open/close the injection hole 571.

The water supply port 530 plays a role in guiding the water stored in the accommodating part 510 to the water tank 210 of the steam generator. Preferably, one end of the water supply port 530 is connected to the accommodating part 510 and one side of the water supply port 530 is configured to protrude inward. And, the other end of the water supply port 530 is connected to the steam generator 200 to be detachably connected to the steam generator 200.

In the configuration that the other end of the water supply port 530 is detachably connected to the steam generator 200, if water is injected into the water accommodating part 510, water can be injected in a manner of detaching the accommodating part 510 from the steam generator 200.

Preferably, the accommodating part 510 and the water supply port 530 are built in one body. Alternatively, the water supply port 530 can be separately formed from the accommodating part 510. In this case, a separate sealing should be taken into consideration to prevent the leakage of the water stored in the accommodating part via the mutually connecting portion.

More preferably, the portion connecting both of the accommodating part 510 and the water supply port 530 together includes a flexible member. This is to facilitate the accommodating part to be upwardly inclined when an external force is applied to the accommodating part to supply water to the steam generator.

Preferably, a damper 550 is further provided to the accommodating part 510 to open/close the water supply port 530. More preferably, the damper 550 is installed in a manner of being fixed to the accommodating part 510 to be inclined in one body of the accommodating part 510. In particular, one end of the damper 550 is fixed to an inside of the accommodating part 510 and the other end is provided to selectively open/close the water supply port 530. In case that the accommodating part 510 keeping a horizontal state does not supply water to the steam generator, the water supply port 530 is turned off not to introduce water to the water supply port 530. In case that water is supplied to the water tank 210 of the steam generator 200 by turning the accommodating part 510 upward, the damper 550 turns on the water supply port 530 to enable the water to be introduced into the water supply port 530.

And, the damper 550 plays a role in preventing the water introduced into the steam generator or the steam generated from the steam generator from flowing backward to the accommodating part 510.

According to the present embodiment, a drawer type container D (hereinafter named 'drawer') is provided to be pulled car or pushed in at a prescribed position of the dryer. And, the water supply means is provided to the drawer D. In this case, the drawer D can be provided to the front cover 16 of the front side of the laundry dryer.

Preferably, an auxiliary cover 710 is further provided to the top cover 17 of the topside of the laundry dryer to open the drawer. So, the accommodating part 510 can be upwardly moved. This is to provide a space for enabling the accommodating part 510 to be upwardly inclined to supply water to the steam generator 200.

An operation of the steam generator including the above-configured water supply source is explained as follows.

First of all, the drawer D is pulled cut of the front side of the laundry dryer to inject water into the accommodating part 510.

After the water supply port 530 of the accommodating part 510 has been separated from the steam generator, water is injected via the injection hole 571 provided to the accommodating part 510. The injection hole 571 is then blocked by the cap 573.

After completion of the water injection into the accommodating part 510, the drawer D is closed as son as the water supply port 530 of the accommodating part 510 is assembled to the steam generator.

Subsequently, the auxiliary cover 710 is opened and the accommodating part 510 is upwardly turned. So, the damper 550 provided within the accommodating part 510 can turn on the water supply port 530.

Once the water supply port 530 is turned on, water is supplied to the water tank 210 of the steam generator 200 via the water supply port 530. After completion of the water supply, the accommodating part 510 is made to return to its initial position. So, the damper 550 turns off the water supply port 530.

If the water is supplied to the steam generator 200 by the above process, the heater 240 of the steam generator 200 is activated to generate steam. The steam is then supplied to the drum via the nozzle 250 to perform the steam drying process.

As mentioned in the foregoing description, the present invention is effective in removing or removing creases despite the differences in dress types, e.g., cloth types, humid absorption, and the like. And, the resent invention is applicable to an object to be dried such as a laundry having been dewatered by a washing machine. Moreover, the laundry dryer according to the present invention is able to remove creases on clothes worn by one day, i.e., already dried clothes with less creases for example. And, the present invention is specifically useful for this case. Thus, the laundry dryer according to the present invention is useable as a sort of a crease remover as well.

INDUSTRIAL APPLICABILITY

Accordingly, the present invention provides the following effects or advantages.

First of all, according to the present invention, creases or wrinkles on a drying-completed object to be dried can be effectively prevented or removed. And, the present invention is also advantageous in sanitizing or deodorizing an object to be dried.

Secondly, according to the present invention, creases or wrinkles on clothes in a dried state can be effectively removed without ironing cut the clothes.

Thirdly, according to the present invention, a water supply means for supplying water to a steam generator has a simple configuration to facilitate its installation and water supply to the steam generator.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A laundry dryer comprising:
a drum rotatably provided to a cabinet;
a hot air heater for heating air to supply hot air to the drum;
a steam generator selectively supplying steam to the drum; and
a water supply source provided to one side of the cabinet, the water supply source comprising:
an accommodating part having a space for storing water supplied to the steam generator; and
a water supply means for supplying the water within the accommodating part to the steam generator, the water supply means comprising a pressurizing part for supplying the water within the accommodating part to the steam generator by pressurizing the water,
the pressurizing part comprising:
a pressurizing member moving along an open one side of the accommodating part to pressurize the water stored in the accommodating part in a vertical direction; and
a sealing member provided along a surface of the pressurizing member, and
further comprising an injection hole provided at the pressurizing member for injecting the water into the space for storing water and a cap for opening and closing the injection hole,
wherein the injection hole perforates through the pressurizing member, and
wherein the water is supplied into the space through the injection hole.

2. A laundry dryer comprising:
a drum rotatably provided to a cabinet;
a hot air heater for heating air to supply hot air to the drum;
a steam generator selectively supplying steam to the drum; and
a water supply source provided to one side of the cabinet, the water supply source comprising:
an accommodating part having a space, which is formed by an upper surface, lower surface and side surface, for storing water supplied to the steam generator,
the accommodating part comprising:
an injection hole through which the water is injected into the space for storing water; and
a cap for opening and closing the injection hole; and
a water supply means for supplying the water within the accommodating part to the steam generator, the water supply means comprising a pressurizing part for supplying the water within the accommodating part to the steam generator by pressurizing the water,
the pressurizing part comprising:
a pressurizing member moving toward the side surface along an open one side of the accommodating part to pressurize the water stored in the accommodating part; and
a sealing member provided along a surface of the pressurizing member,
wherein the injection hole is provided at the upper surface of the accommodating part.

3. The laundry dryer of claim 2, the pressurizing part further comprising a handle provided to one side of the pressurizing member.

4. The laundry dryer of claim 2, further comprising:
a water supply hose connecting the accommodating part and the steam generator together; and
a backward-flowing preventing means provided to the water supply hose.

5. The laundry dryer of claim 4, wherein the backward-flowing preventing means comprises a check valve.

6. The laundry dryer of claim 2, wherein the pressurizing member moves from the open one side of the accommodating part in a horizontal direction.

7. The laundry dryer of claim 2, further comprising a moving means for moving the pressurizing member.

8. The laundry dryer of claim 7, the moving means comprising:
a horizontal bar connected to the pressurizing member to make a horizontal movement; and
a rotatable member connected to one end of the horizontal bar to be rotatably installed.

9. The laundry dryer of claim 8, wherein the rotatable member is rotatably moved between a pressurizing position where the pressurizing member pressurizes the water and a releasing position where the pressurizing member does not pressurize the water.

10. The laundry dryer of claim 9, the moving means further comprising an elastic member for applying an elastic force to the releasing position if the rotatable member is rotatably moved to the pressurizing position.

11. The laundry dryer of claim 1, wherein the accommodating part comprises an expandable/contractible bellows part to have a space for storing the water therein, wherein the pressurizing part is provided to one end of the bellows part.

12. The laundry dryer of claim 11, further comprising:
an injection hole provided to the pressurizing part to inject the water into the bellows part; and
a supply passage connected to the injection hole.

13. The laundry dryer of claim 12, further comprising a cap for opening and closing the injection hole.

14. The laundry dryer of claim 12, further comprising a packing part configured to be rotatably moved to open and close the injection hole.

15. The laundry dryer of claim 12, further comprising a sealing member sealing the supply passage if the bellows part is contracted by the pressurizing part.

16. The laundry dryer of claim 15, further comprising a cover for covering the pressurizing part and the bellows part if the bellows part is contracted by the pressurizing part, wherein the sealing member is provided to a bottom of the cover.

17. The laundry dryer of claim 12, further comprising:
a water supply hose connecting the bellows part and the steam generator together; and
a backward-flowing preventing means provided to the water supply hose.

18. The laundry dryer of claim 12, further comprising:

a first damper provided along the supply passage; and a second damper provided between the bellows part and the steam generator.

19. The laundry dryer of claim 12, further comprising a filter provided along the supply passage.

20. The laundry dryer of claim 1, the water supply means comprising the accommodating part rotatably provided to the steam generator to supply the water to the steam generator by a water column difference.

21. The laundry dryer of claim 20, wherein the accommodating part is rotatably in a vertical direction.

22. The laundry dryer of claim 21, wherein a connecting portion for connecting the accommodating part and the steam generator comprises a rotatable flexible member.

23. The laundry dryer of claim 21, the accommodating part comprising:

a water supply port for supplying the water to the steam generator; and damper turning on/off the water supply port.

24. The laundry dryer of claim 23, wherein the damper is fixed to an inside of the accommodating part adjacent to the water supply port, wherein the damper turns on the water supply port if the accommodating part is rotatably turned to rise, and wherein the damper turns off the water supply port if the accommodating part is lowered.

25. The laundry dryer of claim 21, further comprising an auxiliary cover provided to the cabinet corresponding the accommodating part.

26. The laundry dryer of claim 1, wherein the water supply source is provided to a drawer capable of being pulled out or pushed in the cabinet.

27. The laundry dryer of claim 26, wherein the drawer is provided to a front side of the cabinet.

* * * * *